US006731079B2

(12) United States Patent
Andersen

(10) Patent No.: US 6,731,079 B2
(45) Date of Patent: May 4, 2004

(54) INDUSTRIAL LIGHTING CONTROL SYSTEM AND METHOD

(75) Inventor: Bo Lundager Andersen, Burlington, CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/681,704

(22) Filed: May 23, 2001

(65) Prior Publication Data

US 2002/0175641 A1 Nov. 28, 2002

(51) Int. Cl.[7] ..... H05B 37/04

(52) U.S. Cl. ..... 315/312; 315/129; 315/119; 702/188

(58) Field of Search ..... 315/129, 119, 315/151, 307, 308, 291, 323, 292–295, 312, 316, 318, 320, 324; 702/188

(56) References Cited

U.S. PATENT DOCUMENTS 4,991,054 A * 2/1991 Walters ..... 315/159
5,479,159 A * 12/1995 Kelly et al. ..... 315/119
5,815,086 A 9/1998 Ivie et al. ..... 340/825.52
5,962,991 A * 10/1999 Levy ..... 307/36
5,977,717 A * 11/1999 Dean ..... 250/205
6,028,396 A * 2/2000 Morrissey. et al. ..... 315/119
6,259,215 B1 * 7/2001 Roman ..... 315/224
6,373,201 B2 * 4/2002 Morgan et al. ..... 315/291
6,448,715 B1 * 9/2002 Fujiwara et al. ..... 315/129

* cited by examiner

*Primary Examiner*—James Clinger
*Assistant Examiner*—Ephrem Alemu
(74) *Attorney, Agent, or Firm*—Cantor Colburn LLP

(57) ABSTRACT

A lighting control module for controlling power to a lamp is presented. The lighting control module comprises a receiver for receiving electronic communications from a central controller, a current sensor, a current controller for controlling current in a power circuit passing through the module, the current controller operating to open and close the power circuit, a control unit connected to the current controller and the receiver, the control unit operating to cause the current controller to open and close the power circuit in response to the communications, and an indicator connected to the control unit. The control unit causes the indicator to illuminate when the current sensor indicates that current fails to flow in the power circuit when the current controller is operated to close the power circuit.

9 Claims, 5 Drawing Sheets

INDUSTRIAL LIGHTING CONTROL SYSTEM AND METHOD

BACKGROUND OF INVENTION

This invention relates generally to lighting systems and, more specifically, to industrial lighting and high end commercial lighting control systems and a method therefor.

Industrial lighting and high end commercial lighting will be commonly referred to herein as "industrial lighting." The traditional approach for providing industrial lighting to large areas, such as arenas, parking lots, and conference rooms, is shown schematically in FIG. 1. Lighting system 10 includes a switch 12, which may be a wall switch as shown or an activation switch. Switch 12 provides a control current to one or more lighting panels 14. Only one lighting panel 14 is shown for purposes of illustration, though there may be any number of panel boards. Main power line 18 feeds power to a main contactor 11, which may be a main circuit breaker. Main contactor 11 feeds power to a number of branch contactors 15 located within lighting panel 14. Contactors 15 may include simple relays, dimmers, and/or remote-controlled circuit breakers. Each contactor 15 controls current to a branch circuit 22, which provides power to a plurality of light fixtures 20.

The lighting contactor system is activated when switch 12 is turned on sending a control current to contactors 15 via wiring 16. Contactors 15 close the power circuit in response to receiving the control current from switch 12, allowing electrical power to flow to fixtures 20 via branch circuits 22. If a dimmer is incorporated into contactors 15, then the power may be regulated by it.

Current industrial lighting contactor systems as described above possess several electro-mechanical problems. Because most light fixtures draw an increased amount of current while warming up, the main contactor experiences large current surges at the instant of closure. Moreover, high in-rush currents, high induced EMF's, and the like can reduce their expected service life by eroding the contact surfaces.

Additional problems stem from the centralized wiring systems currently employed. To provide the necessary current to operate heavy industrial loads such as in lighting auditoriums, stadiums, factories, etc. heavy wiring must be routed through a central location where the lighting contactors are installed. In such situations, lighting contactors are prone to produce an unpleasant and disruptive electrical hum and/or vibration caused by the high concentration of current. Furthermore, in these highly centralized systems, if a contactor fails, all of the lights that it controls will be rendered inoperative.

Conventional industrial lighting systems have furthermore not adequately met the needs of their users. For instance, conventional industrial lighting systems have no means of collecting and displaying wear data on the system, so that maintenance personnel can anticipate problems, such as a contactor failure or wearout, lamp failure or wearout, or other problem before it occurs. Furthermore, there is no system in place to remotely detect lamp failures.

For the past decade a number of companies have marketed residential lighting control systems comprised of wall switches, wall outlets, and various other devices equipped with electronics. These products have enabled a residential or low-end commercial user to remotely switch multiple lamps and other loads via a control panel. Traditionally, the communication technology for this type of application has been through hard-wired networks, RF communications and power line based communications.

However, conventional residential lighting systems have not addressed the issues discussed above with respect to industrial lighting. In particular, conventional residential lighting systems do not provide a means to monitor the usage for lamps and other loads. Furthermore, conventional residential lighting systems are not designed to alert the user of lamp failures, nor do they address the problems of rapid surges and sudden voltage drops that can occur when a large lighting system is energized.

What is needed is a functional replacement and enhancement to conventional technology that reduces power surge problems, provides sensing capability for determining defective lamps, decentralizes lighting contactors, and operates despite single point failures.

SUMMARY OF INVENTION

The above discussed and other drawbacks and deficiencies are overcome and alleviated by a lighting system that includes a plurality of lighting control modules for controlling power to a respective lamp. Each module comprises a signal receiving means for receiving electronic communications from a controller, a current sensor, a current controller for controlling current in a power circuit passing through said module, said current controller operating to open and close said power circuit, a control unit connected to said current controller and said signal receiving means, said electronics operating to cause said current controller to open and close said power circuit in response to said communications from said signal receiving means, and an indicator connected to said electronics, said electronics causing said indicator to illuminate when said current sensor indicates that current fails to flow in said power circuit when said current controller is operated to close said lower circuit.

The above discussed and other features and advantages of the present invention will be appreciated and understood by those skilled in the art from the following detailed description and drawings.

BRIEF DESCRIPTION OF DRAWINGS

Referring to the exemplary drawings wherein like elements are numbered alike in the several Figures.

DETAILED DESCRIPTION

Figure 1:
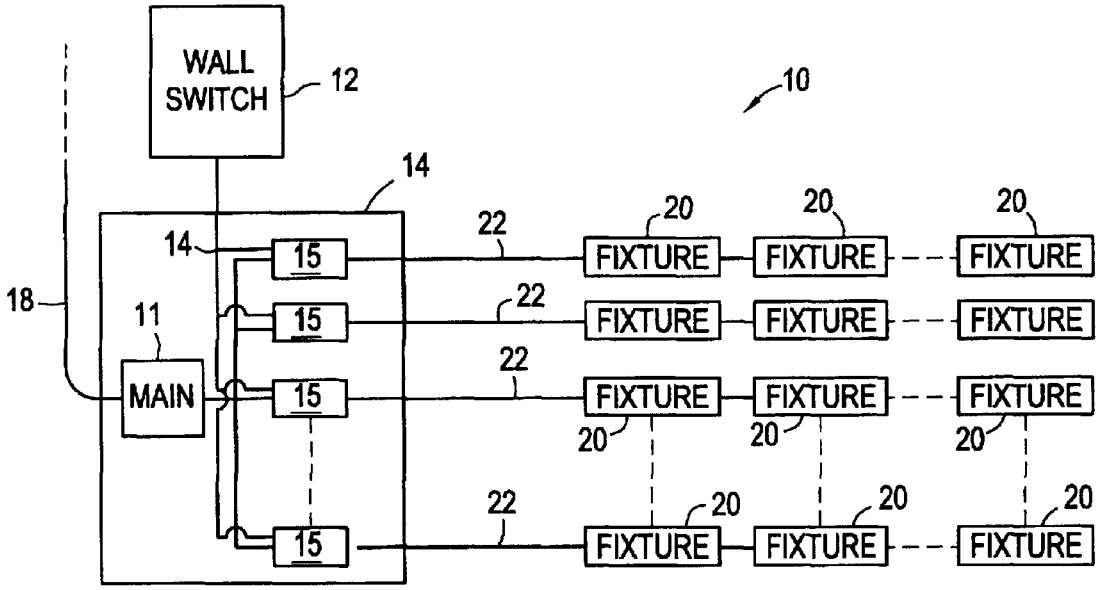
FIG. 1 PRIOR ART
FIG. 1 is a schematic diagram of a light control and dimmer system using a high-amperage lighting contactor consistent with the prior art.
Figure 2:
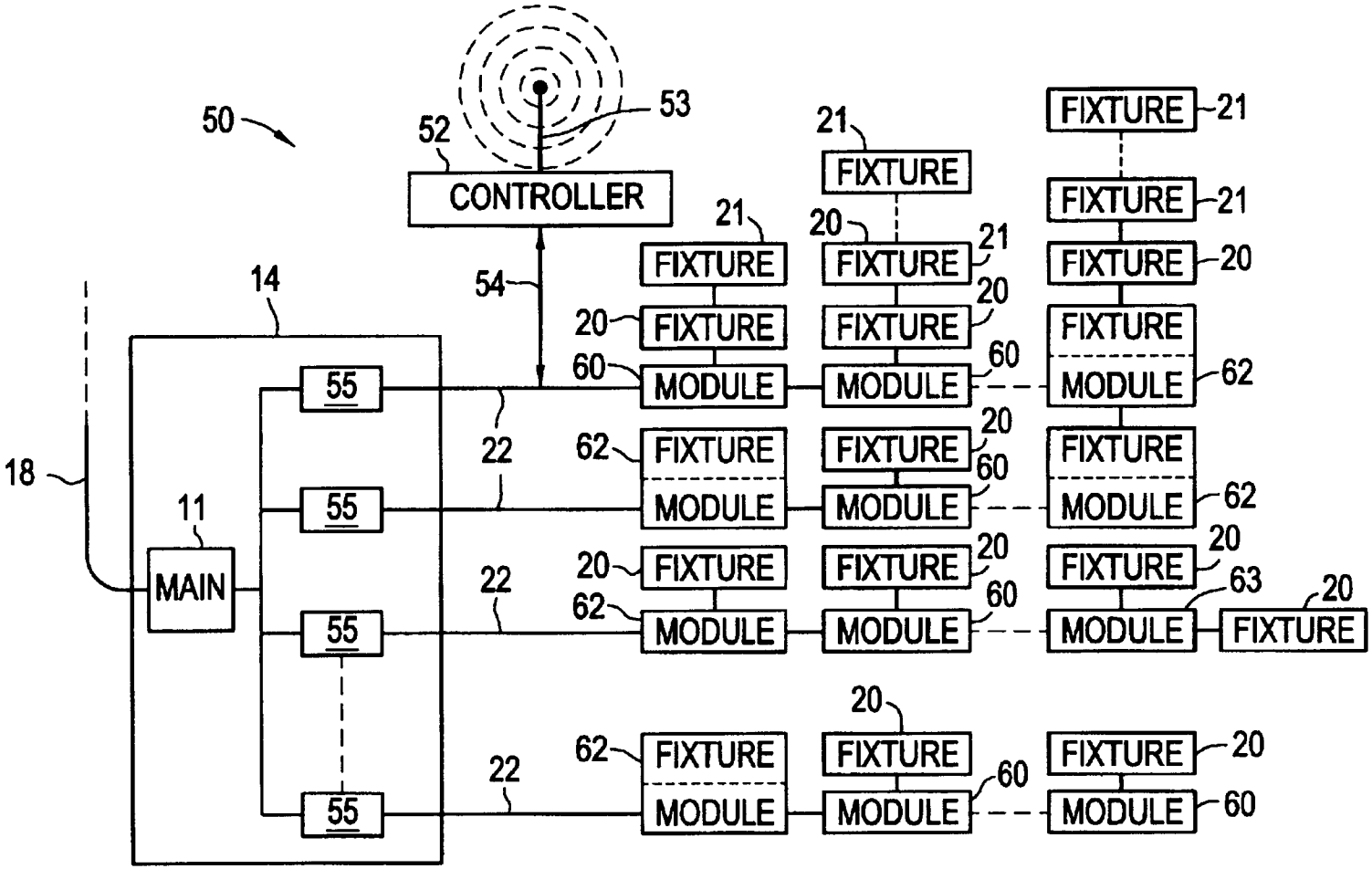
FIG. 2 is schematic diagram of a multiple integrated light control using light fixture modules.

FIG. 2 shows a simplified schematic diagram of a lighting control system 50. Main power line 18, which may be a conventional 3-wire 220V AC power line, feeds into main contactor 11 and one or more branch circuit breakers 55, each controlling a 110V AC branch circuit, as is well known. For simplicity, FIG. 2 does not show the separate phases, ground, and neutral lines. Each branch circuit breaker provides power to one or more modules 60, module-fixtures 62, or combinations thereof. Modules 60 control power to associated fixtures 20. Other electric loads, such as ventilation fans, air conditioners, heaters, other environmental equipment, or other equipment in general can be connected to modules 60 as well. Fixtures 20 and module-fixtures 62 operate on 110V AC power. However, it should be understood that the invention is equally applicable to systems using different voltages.

As shown in FIG. 2, module-fixtures 62 can be used interchangeably with modules 60 each having a fixture 20 attached to it. Also, modules 60 and module-fixtures 62 can control a fixture 20 and any number of additional, auxiliary fixtures 21 by connecting them in parallel with fixture 20. For each module 60, the fixture 20 and auxiliary fixtures 21 are turned on or off or are dimmed together. Likewise, for each module-fixture 62, the lamp connected to the module-fixture 62 and auxiliary fixtures 21 connected to it are also turned on or off or are dimmed together. It is also possible to provide a module or module-fixture with multiple independently-controlled outputs as in multi-module 63, which is shown as having to fixtures connected to separate outputs thereof in FIG. 2. The dashed lines in FIG. 2 represent that any selected number of branch circuits form the lighting system, any number of modules can be positioned on each branch circuit, depending, of course, on the current limitations of the circuit, and any number of fixtures can be connected to and controlled by each module, again, depending on the current limitations of the circuit.

Modules 60 and module-fixtures 62 are in communication with a controller 52. Communication is achieved by radio, e.g., via antenna 53, or by signal connection 54 to branch circuits 22. In the latter case, communication is achieved by transmitting high-frequency signals through branch circuits 22 in the well-known manner. For example, the communications may be made over ordinary power lines using the CEBus™ protocol standard that is promulgated by the Electronics Industries Association. In addition to these preferred methods, communication may be established over other known mediums including twisted pair (telephone), coaxial cable, fiber optics, and infrared. As is known, these methods may be augmented by interfacing computer networks, such as a campus-wide, wide-area network or even using an Internet interface. So, while the system is shown in FIG. 2 as being powered through a single main circuit breaker, there is no such limitation in actual practice. Using known electronic communications techniques, controller 52 is capable of controlling any number of modules positioned anywhere, whether on a single main power distribution circuit or not.

Controller 52 may be a dedicated wall-mounted switch, control console, or a general-purpose personal computer. The lighting control system 50 may include centralized or distributed useful-life monitoring and turn-on delay control. In the centralized model, the controller 52 tracks usage of each lamp corresponding to a respective module 60 or module-fixture 62 and individually delays the turn-on for each lamp attached thereto. In the distributed model, the controller 52 sends general ON, OFF, or DIM % commands to all modules 60 and module-fixtures 62. Controller 52 may have the capability to individually address and separately control each module 60 and module-fixture 62, but in many applications, such lighting for parking lots, factories, and warehouses, this functionality is not required.

Figure 3:
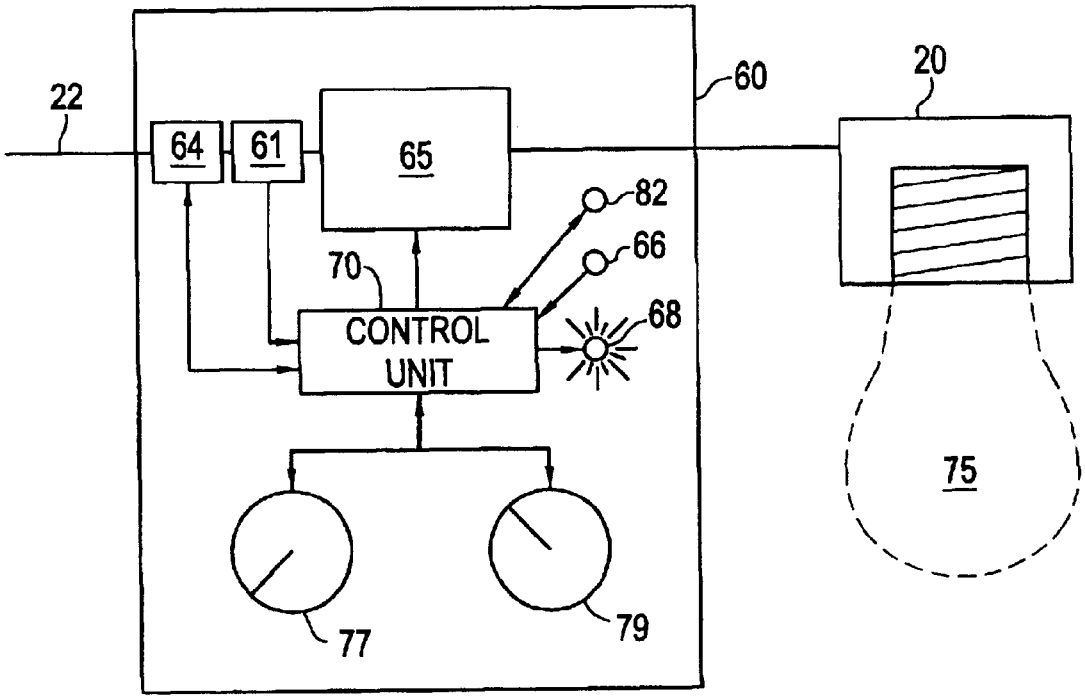
FIG. 3 is light fixture module with a LED indicator.
Figure 4:
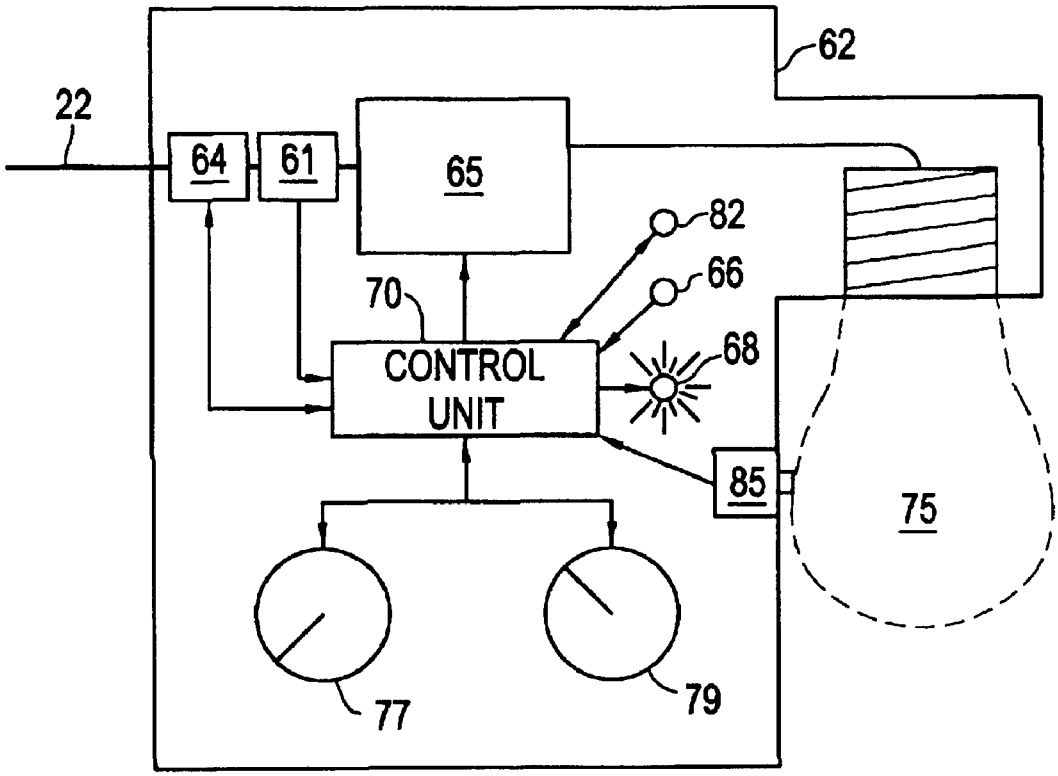
FIG. 4 is light fixture module with an electronic light dimmer.

FIGS. 3 and 4 show respectively a schematic diagram of a module 60 and a module-fixture 62. Each module 60 and module-fixture 62 includes a control unit 70 in communication with controller 52. For example, a signal processor 64 that is in communication with control unit 70 sends and receives signals sent through branch circuits 22 in the known manner. Control unit 70 is connected to current controller 65, which may be a relay mechanism or dimmer such as are known. Current controller 65 controls the current to lamp 75, which is either connected in a separate fixture 20 shown in FIG. 3 or is connected directly into module-fixture 62 as shown in FIG. 4. Lamp 75 may be any type of commercially available light source, such as an incandescent lamp, mercury-vapor lamp, fluorescent lamp, or other discharge device. Any required additional electronic components required for lamp 75 such as ballasts or other current-regulating means are omitted from the drawings, as they do not form a part of the invention. For the embodiment shown in FIG. 3, such components would be connected between current controller 65 and lamp 75 either in a separate housing or located within or attached to fixture 20 as is known, or within module 60.

The electronics package in each module 60 and module-fixture 62 includes a current sensor and power supply 61. Current sensor and power supply 61 detects the current in line 27 leading to lamp 75 and provides electrical power to control unit 70 and other associated components in a known manner even when no power flows through line 27. In an alternative embodiment, Current sensor and power supply 61 is a current transformer that senses current in line 27 and provides electricity to control unit 70 only when current is flowing in line 27. In this case, control unit 70 includes a battery or other electricity storage device (not shown) to provide electricity even when lamp 75 is off.

Current sensor and power supply 61 can detect whether lamp 75 fails to generate a load when ordered to turn on and thus is defective or has died. In that case, an electronic message is sent out to controller 52 indicating a lamp failure and a visible indicator 68 is turned on. Indicator 68 may take the form of a light emitting diode, a mechanical flag, or equivalent. Indicator 68 remains on even after the lamps are turned off, e.g., when parking lot lamps are turned off during the day, to thereby alert maintenance personnel of the defective lamp.

Control unit 70 includes a number of other sensor inputs. Module 60 and module-fixture 62 contain a timer 77 with a range from, e.g., 0 to 10, or 0 to 100 thousands of operating hours. Timer 77 may count down from a number of hours before lamp 75 is due to be replaced, or count up from the time lamp 75 was replaced to an expected number of hours of operation of lamp 75. Timer 77 may, for example, be a turn-wheel. In this case, the electrician installing lamp 75 will reset the timer to indicate the number of hours of operation before the next replacement is scheduled, e.g., the expected life of lamp 75, if timer 77 is a count-down timer. If timer 77 is a count-up timer, then the maintenance person will reset timer 77 to zero and ensure that an alarm setting is set to the number of hours of operation before the next replacement is scheduled.

When the lamp is turned on, control unit 70 operates timer 77 to slowly rotate the turn-wheel towards zero, if timer 77 is a count-down timer, or slowly rotate the turn-wheel away from zero, if the timer 77 is a count-up timer. In this way, timer 77 operates to indicate the remaining hours-of-operation of the connected lamp 75 before replacement is due. When timer 77 reaches zero or the selected alarm value, indicator 68 will illuminate, indicating that the replacement is due for lamp 75.

The function of timer 77 may be implemented either completely electronically, or electro-mechanically, as would be appreciated by a skilled artisan. It is also contemplated that timer 77, while preferably implemented as a turn-wheel as shown in FIGS. 3 and 4 due to its simplicity of operation, may be replaced with a digital interface, with the timing and indicating function performed by software within control unit 70 and a digital display (not shown).

Module 60 and module-fixture 62 also include a turn-on delay timer 79. The turn-on delay timer 79 includes settings from instantaneous to several seconds. For some lamp types having long warm-up times, the possible settings may be even greater. Turn-on delay timer 79 may also include a random setting, which allows control unit 70 to select a random turn-on delay. Selecting a variety of turn-on delays for all the fixtures in a lighting system will eliminate the current surge/voltage drop caused by a large number of lamps being turned on simultaneously.

In some outdoor installations, module 60 and module-fixture 62 may include a photo-sensor 66 to detect ambient light conditions. In this case, when control unit 70 receives an "on when dark" command, it will control current controller 65 to turn on lamp 75 only when there is insufficient ambient light available. For example, when the ambient light level drops to a first threshold, control unit 70 will turn on lamp 75, and when the ambient light reaches a second threshold higher then the first threshold, the control unit 70 will turn off lamp 75. Although not required, the use of two thresholds reduces flickering.

Alternatively, only one or several of modules 60 or module-fixtures 62 include a photo-sensor 66, and control unit 70 thereof is periodically queried by controller 52 as to the current level of ambient light. Upon receiving this query, control unit 70 responds by sending a signal to controller 52 indicating the current ambient light level. When the ambient light reaches a user-selected lower threshold, controller 52 sends a signal to all modules 60 and/or module-fixtures 62 to turn on lamps 75. Querying several modules 60 and/or module-fixtures 62 will provide redundancy in case one of the photo-sensors malfunctions or becomes covered with debris.

Infrared (IR) transceiver 82 may be provided in each module 60 and module-fixture 62 for allowing communication between control unit 70 within the modules 60 and module-fixtures 62 and a hand-held controller device (not shown). There are many potential uses for IR transceiver 82. For example, a single hand-held controller may replace timer 77 and separate turn-on delay 79 in each module 60 or module-fixture 62, and all the functions are handled instead through the hand-held control device, which may be a hand-held computer such as a dedicated device or a Palm Pilot™, WindowsCE™ device, or equivalent, equipped with a standard IR interface and software allowing it to interact with control unit 70. Thus, by simply pointing the hand-held device to a light fixture, communication can be thereby established, and information as to the maintenance can be downloaded to the hand-held device, and instructions can be transmitted to control unit 70, including ON or OFF commands, as well as setting the turn-on delay and hours-of-operation of lamp 75. IR transceiver 82 may be disposed in a separate housing (not shown) and mounted adjacent to fixture 20 or module-fixture 62 in situations where a reflector (not shown) of the light fixture would otherwise block a line-of-sight to IR transceiver 82. This could be a solution in warehouse and factory lighting applications where large reflectors are sometimes employed.

IR transceiver 82 can also be used as a means of communicating with controller 52, which may be useful if the module or module-fixture is connected to a completely different circuit and thus cannot communicate via branch circuit 22.

The above description relates to a distributed model of monitoring lamp life and controlling turn-on delay. In an embodiment employing a centralized model, the functions described above are performed by controller 52 in a central or remote location by a control console or a general-purpose computer as previously described. In this model, controller 52 maintains a database or list of each module 60 and/or module-fixture 62 with associated hours-of-operation data and turn-on data of connected lamps 75. With regard to the hours-of-operation, information is input into controller 52 when a lamp replacement is made, and the expected hours of operation of the replacement lamp. This input can be done manually by a technician at the time of lamp replacement, or automatically. For example, module-fixture 62 may include a lamp sensor 85 having a plunger-switch to detect the removal of lamp 75.

Other means of detecting the removal of lamp 75 are contemplated, such as an optical sensor or magnetic sensor disposed in the lamp base. Alternatively, control unit 70 of either a module 60 or module-fixture 62 may perform a periodic continuity check on lamp 75. When the continuity is broken, that is an indication that the lamp is either removed or burned-out. This technique has the advantage that it will work with conventional fixtures, e.g., fixture 20. Other types of sensors may be used as well, as would occur to the skilled artisan.

Regardless as to the type of sensor employed, when it detects that lamp 75 is replaced, it sends a signal to control unit 70, which sends a signal to controller 52. Controller 52 identifies the address of the module-fixture 62 that sent the signal, and responds by resetting the hours-of-operation data for that fixture to the selected amount.

The controller automatically and periodically decrements the hours-of-operation remaining for each lamp 75 that that lamp is on. For example, every hour, controller 52 may check which lamps are on, and decrement the hours-of-operation data for those lamps by one. Alternatively, controller 52 may track the minutes or other fractions of an hour, such as tenths of an hour (i.e., six-minute increments), of operation for each lamp, and sum the total as a fraction of hours. When the hours-of-operation data reaches zero for any one module 60 or module-fixture 62, a signal is sent to that module 60 or module-fixture 62 causing it to illuminate its indicator 68, thereby informing maintenance personnel that the connected lamp 75 is due to be replaced.

Similarly, when a lamp 75 fails to generate a load, control unit 70 senses this and sends a signal to controller 52, indicating that the lamp is no longer functioning.

Controller 52 then sends a signal back to that module 60 or module-fixture 62, causing it to illuminate its indicator 68. In addition, controller 52 informs the operator that the lamp no longer functions, and may provide a graphic or other indication as to the location of the non-functioning lamp.

To turn on the lamps in lighting control system 50, the operator simply inputs the instruction into controller 52. This input may take the form of flipping a switch from "OFF" to "ON", or pressing an "ON" button, or interacting with a software program on a computer, in any known manner. For example, a graphical-user interface or other interface can allow the operator to select specific lamps, or every-other lamp, every $10^{th}$ lamp, or other predetermined groupings of lamps. In some environments, such as a conference center, having individual control over each lamp is very advantageous. In this case, a map of the conference center can be displayed on a computer screen showing the location of each lamp, and each lamp can be individually controlled simply by selecting it and entering a command via a pop-up menu or the like. Individual lamps may be selected by simply clicking the representation on the screen of the lamp, and multiple lamps can be selected by dragging a box around the lamps to be turned on off, or dimmed.

Figure 5:
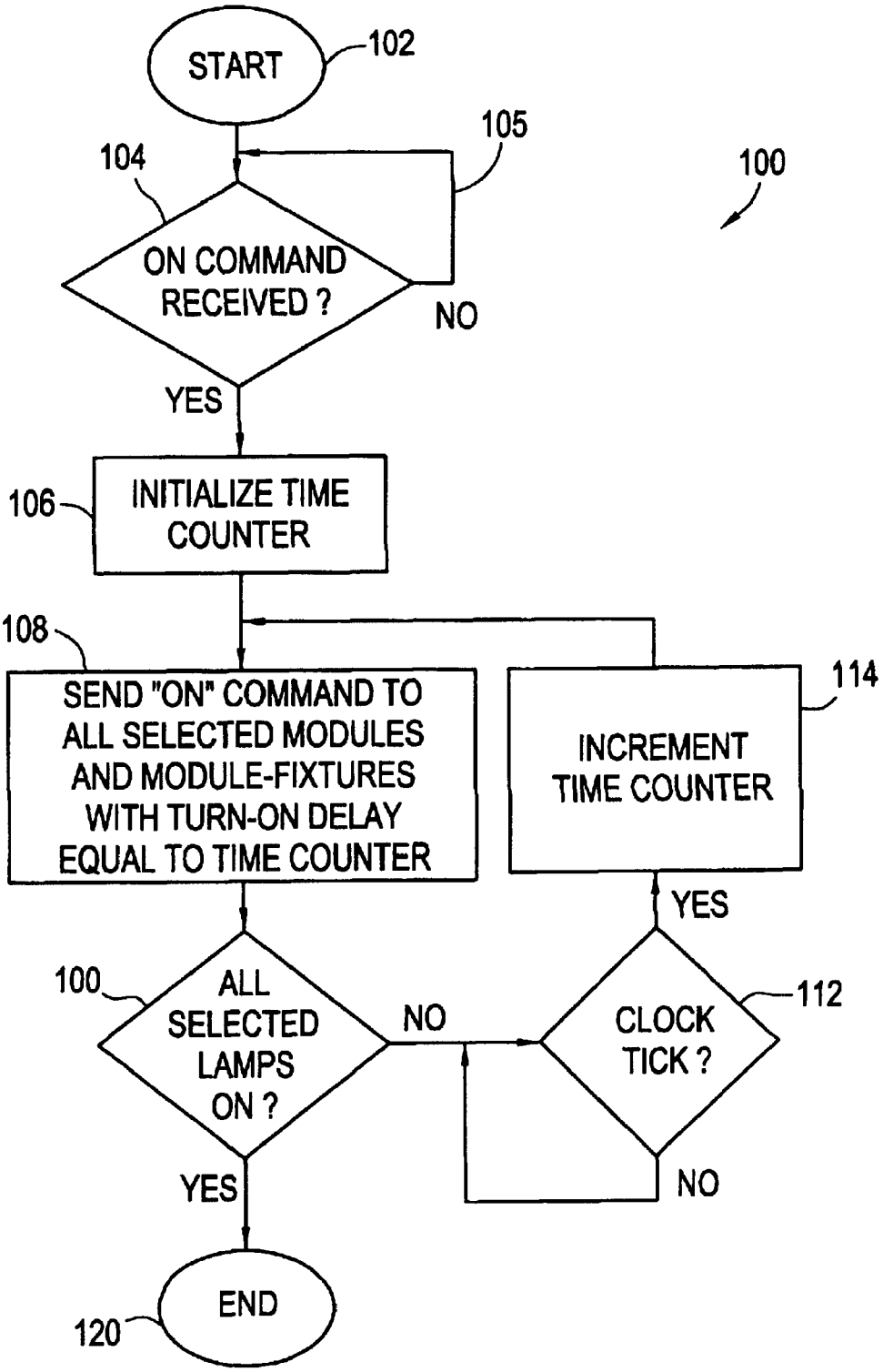
FIG. 5 is a flow chart of an exemplary process in accordance with an embodiment of the invention.

Upon receiving the operator's input instruction for turning on a large number of lamps, controller 52 delays turning on each selected lamp by the amount recorded in its database. FIG. 5 shows a flow chart describing an exemplary process for delaying the start-up time for each lamp.

After starting at box 102 the controller immediately proceeds to box 104 where the controller 52 waits for an ON command for selected lamps by loop 105. After an ON command is inputted into controller 52, controller 52 proceeds to box 106 where the time counter variable is initialized to zero. Then, at box 108, the controller compares the time counter with the turn-on delay value for each selected light fixture. For those selected light fixtures having a turn-on delay that is equal to the value of the time counter, an "ON" command is transmitted to the corresponding modules 60 and/or module-fixtures 62. Controller 52 then proceeds to box 110 wherein a check is performed as to whether all the selected lamps are turned on. If not, the controller proceeds to box 112 and waits for the next clock tick. Clock ticks can be every $10^{th}$ of a second or otherwise, depending upon the application. Transmission of "ON" commands in box 108 may be processed in parallel, to ensure that each clock tick is counted. When the next clock tick is received, controller 52 proceeds to box 114 wherein the time counter is incremented by the appropriate amount. Controller 52 thereafter returns to box 108 and continues as before.

If the controller reaches box 110 and all selected lamps have been turned on, the controller exits the turn-on delay loop and proceeds to box 120 where the procedure is ended. The turn-on delay data stored in controller 52 may be manually input into controller 52 or the operator can select the time spread for the lamps and instruct controller 52 to automatically select turn-on delays either sequentially or randomly. Alternatively, the operator can simply input the type of lamps used and allow the controller 52, using stored data, to select optimum start-up timings for the lamps in lighting control system 50. The start-up timings will depend on the warm-up time for the type of lamps installed, and limit the total number of lamps warming up at any one time to a selected number of lamps.

While preferred embodiments have been shown and described various modifications and substitutions may be made thereto without departing from the spirit limitation and scope of the invention. Accordingly, it is to be understood that the present invention has been described by way of illustration and not limited to the illustrative embodiments.

What is claimed is:

1. A lighting control system for controlling a plurality of lamps comprising:

at least one central controller in electronic communication with a plurality of modules for controlling power to respective one of said lamps, each said module comprising:

a means for receiving electronic communications from said central controller;

a current sensor;

a current controller for controlling current in a power circuit passing through said module, said current controller operating to open and close said power circuit;

control unit connected to said current controller and said means for receiving electronic communications, said control unit operating to cause said current controller to open and close said power circuit in response to said communications;

an indicator connected to said control unit;

timer for counting hours-of-operation of the lamp, said timer including means for resetting the timer when said lamp is replaced with a new lamp;

wherein said control unit causes said indicator to illuminate in response to said timer having counted a selected number of said hours-of-operation, for indicating that the lamp is due to be replaced;

wherein said central controller is operable to uniquely identify and communicate with individual ones of said modules; and wherein said central controller operates to prevent a selected number of said lamps from being simultaneously turned on by delaying turning on selected ones of said lamps by delaying instructions to corresponding modules.

2. A lighting control module for controlling power to a lamp, said module comprising:

a means for receiving electronic communications from a central controller;

a current sensor;

a current controller for controlling current in a power circuit passing through said module, said current controller operating to open and close said power circuit;

a control unit connected to said current controller and said means for receiving electronic communications, said control unit operating to cause said current controller to open and close said power circuit in response to said communications, said control unit operating to delay closing said power circuit by a user-selectable amount of time after said means for receiving electronic communications receives an instruction to close said power circuit.

3. The lighting control module of claim 2 further comprising:

a delay timer control connected to said control unit, said user-selectable amount of time being determined by a setting of said delay timer control.

4. The lighting control module of claim 3 wherein said delay timer control comprises a turn-wheel.

5. The lighting control module of claim 2 wherein a random amount of time is selectable as said user-selectable amount of time wherein when said user-selectable amount of time is said random amount of time, said control unit operates to delay closing said power circuit by a randomly generated amount of time.

6. A lighting control system for controlling a plurality of lamps comprising:

at least one central controller in electronic communication with a plurality of modules for controlling power to respective one of said lamps, each said module comprising:

a means for receiving electronic communications from said central controller;

a current sensor;

a current controller for controlling current in a power circuit passing through said module, said current controller operating to open and close said power circuit;

a control unit connected to said current controller and said means for receiving electronic communications, said control unit operating to cause said current controller to open and close said power circuit in response to said communications;

said centrol controller operable to uniquely identify and communicate with individual ones of said modules; and said control unit operating to delay closing said power circuit by a user-selectable amount of time after said means for receiving electronic communications receives an instruction to close said power circuit.

7. The lighting control system of claim 6, said control module further comprising;

a delay timer control connected to said control unit, said user-selectable amount of time being determined by a setting of said delay timer control.

8. The lighting control system of claim 7 wherein said delay timer control comprises a turn-wheel.

9. The lighting control system of claim 6 wherein a random amount of time is selectable as said user-selectable amount of time wherein when said user-selectable amount of time is said random amount of time, said control unit operates to delay closing said power circuit by a randomly generated amount of time.

* * * * *